US006845889B2

(12) United States Patent
Killoran et al.

(10) Patent No.: US 6,845,889 B2
(45) Date of Patent: Jan. 25, 2005

(54) SPHERICAL BEVERAGE CONTAINER

(76) Inventors: Noel Killoran, Gables End, Mountain Road, Tubbercurry, County Sligo (IE); Dominic Logan, Paradigm Product Development, 5F Weavers Court, Linfield Road, Belfast BT12 5GL, Northern Ireland (GB); Gabriel Harris, Unit 5, Castleblaney Enterprise Centre, Castleblaney, County Monaghan (IE)

( * ) Notice: Subject to any disclaimer, the term of this patent is extended or adjusted under 35 U.S.C. 154(b) by 0 days.

(21) Appl. No.: 10/343,697

(22) PCT Filed: Jul. 31, 2001

(86) PCT No.: PCT/IE01/00100

§ 371 (c)(1),
(2), (4) Date: Aug. 21, 2003

(87) PCT Pub. No.: WO02/10035

PCT Pub. Date: Feb. 7, 2002

(65) Prior Publication Data

US 2004/0031818 A1 Feb. 19, 2004

(30) Foreign Application Priority Data

Jul. 31, 2000 (EP) ..... 00202723

(51) Int. Cl.[7] ..... B65D 37/00

(52) U.S. Cl. ..... 222/212; 222/521; 222/525; 222/78; 446/475

(58) Field of Search ..... 222/78, 212, 206, 222/213, 214–215, 519–525; 446/75–76, 197, 202, 267, 475

(56) References Cited

U.S. PATENT DOCUMENTS

| | | | | | |
|---|---|---|---|---|---|
| 2,717,727 | A | * | 9/1955 | Robb | 222/512 |
| 4,164,284 | A | * | 8/1979 | Witt et al. | 206/217 |
| 4,339,062 | A | * | 7/1982 | Witt, Jr. | 224/148.4 |
| 4,805,807 | A | * | 2/1989 | Perne et al. | 222/153.06 |
| 4,834,382 | A | * | 5/1989 | Spector | 473/603 |
| 5,284,272 | A | * | 2/1994 | Wei | 222/192 |
| 5,380,002 | A | * | 1/1995 | Spector | 473/519 |
| 5,462,273 | A | * | 10/1995 | Spector | 473/594 |
| 5,503,305 | A | * | 4/1996 | Anderson | 222/180 |
| 5,638,982 | A | | 6/1997 | Spector | 220/630 |
| 5,662,241 | A | * | 9/1997 | Sorensen | 220/630 |
| D392,844 | S | * | 3/1998 | Todorya | D7/606 |
| 5,988,448 | A | * | 11/1999 | Foth | 222/189.09 |

FOREIGN PATENT DOCUMENTS

| | | |
|---|---|---|
| DE | 78 27 681 | 3/1979 |
| FR | 2 350 767 | 12/1977 |
| FR | 2 600 978 | 1/1988 |
| GB | 1 263 107 | 2/1972 |

* cited by examiner

*Primary Examiner*—Frederick Nicolas
(74) *Attorney, Agent, or Firm*—Rossi & Associates

(57) ABSTRACT

A container for liquid includes a body portion for accommodating liquid and a release portion for selective release of liquid contained in the body portion. The body portion and the release portion together define a container structure shaped to facilitate manual throwing and/or catching of the container and/or rolling of the container along the ground while liquid is accommodated within the container. The container structure defined by the container is suitably substantially spheroidal. The body portion is preferably substantially deformable, to facilitate expulsion of liquid contained in the body portion by external squeezing. The release portion includes a frame portion and a seal portion. The seal portion is displaceable relative to the frame portion to occlude or to expose a discharge outlet for the passage of liquid through the outlet. Relative displacement between the seal portion and the frame portion may be rotational, delimited between end positions, and accompanied by relative axial displacement of these components.

17 Claims, 10 Drawing Sheets

SPHERICAL BEVERAGE CONTAINER

BACKGROUND OF THE INVENTION

1. Field of the Invention

This invention relates to containers, in particular containers for liquids, for example liquids such as beverages. The invention is especially directed to beverage containers for use in sport, and in particular, for use in field games.

2. Description of the Prior Art

In recent years, there has been increasing awareness of the need for players in field sports to avoid serious dehydration during the course of a game. This is particularly the case where the field game is played in hot environments, in which case the players may perspire copiously. The problem is particularly acute for players from temperate countries playing in hot climates, but while less dramatic, it is nonetheless also significant for field games under temperate conditions. It is especially important for young players to avoid serious dehydration.

FR-A-2 350 767 describes a container for cosmetics or the like, in the container body is approximately spherical and is closed by a cap which is illustrated as being of approximately part-spherical external profile. The container body terminates at an upper flat face with a central screw-threaded stub. A dispenser is located within the stub. The cap has on its underside an internal screw-threaded cylinder which screws onto the stub. A central discharge opening in the cap is closed off in the closed condition of the container by a button part of the dispenser portion of the container body. Stop-limited rotation of the cap between is accompanied by axial displacement of the cap between open and closed dispositions. The screw cap is provided with an annular ring at the edge which is partially separable from the cap along a tear line. The ring, following separation, may serve as a suspension loop for the container.

U.S. Pat. No. 5,638,982 describes a container adapted to store a beverage, and, when empty, to function as a playball. The container includes a spherical shell formed of a flexible synthetic plastics material having a tubular neck projecting from the shell. A screw-on cap is received on the neck. The neck can be retracted into the shell, in which disposition the neck then assumes a re-entrant form. The cap is then held within the shell and flush with the shell. In a storage mode, the shell is filled with a beverage and sealed by the flush cap. To change to an active mode, the shell is squeezed. The internal pressure produced by the squeezing action causes the cap to pop out and the neck to project. The cap can then be unscrewed to dispense the beverage. In the play mode, the shell is empty and the air within the shell is sealed in by the cap, which is again depressed to be flush with the shell. The container now defines a pneumatic play ball.

GB-A-1 263 107 describes a container for foodstuffs such as ice cream. The container includes a hollow body moulded from plastics in the form of an ellipsoid of rotation divided into a small portion and a large portion on a plane transverse to the longest axis of symmetry of the unit. The container portions are connected together by snap action. The unit is designed to facilitate automatic filling and closure, easy opening for consumption and easy subsequent reclosure. The overall external shape is easy and comfortable to grip in the hand. As illustrated, the container is in the shape of a rugby ball. A lateral tab facilitates release of the snap connection between the container portions in order to open the container. After consumption of the contents of the container, the lateral tab may be removed. The container can then be re-closed, substantially permanently, and used as a toy in the form of a rugby football.

DE-U-78 27 681 describes a multipurpose container, in particular for foodstuffs. The container is formed from a thermoplastic material and the container may symbolise a football. As illustrated, the container is formed from two substantially hemispherical half-shells, with flattened top and bottom surfaces in the assembled condition. A generally planar lid is received on the top of the container. A series of the containers can be stacked in a space-saving manner, one on top of the other, by a projecting portion of the lid of a lower container being received within a recessed region of the bottom surface of an upper container.

FR-A-2 600 978 describes a dispensing stopper for pasty products. A rotating cap is mounted on the stopper. Axial displacement of the rotating cap is effected by cooperation of two series of contacting oblique projections on the stopper and cap respectively for closing movement and by cooperation of ramps on the stopper and stops on the cap for opening movement. The base of the cap is further provided with a tearable guarantee strip. The cap can be pushed onto the stopper by simple axial effort, thereby enabling assembly. Manufacture of the stopper and cap is also simplified since these pieces comprise only a very small number of undercut parts.

None of the foregoing describe a container adapted for active use on a sports field, in particular to enable the distribution of a beverage to players engaged in a field game.

BRIEF SUMMARY OF THE INVENTION

It is an object of the invention to provide an improved liquids container, in particular suitable for use in sport, especially for use on playing fields during field games, for example to hold a beverage for consumption during a game.

According to the invention, there is provided a container for liquid, the container comprising a body portion for accommodating liquid and a release portion for selective release of liquid contained in the body portion, characterised in that the body portion and release portion together define a container structure shaped to facilitate manual throwing and/or catching of the container and/or rolling of the container along the ground while liquid is accommodated within the container, in particular during use in a sporting environment.

The body portion preferably defines a greater proportion of the container structure and the release portion comprises a lesser proportion of the container structure, the body portion and the release portion together defining a substantially continuous external surface of the container structure, suitably in an arrangement having at least one axis of symmetry.

The external surface of the container structure may provided with one or more features to facilitate manual engagement of said external surface, for example in the form of at least one raised or recessed region or area of the external surface of the container structure or alternatively by at least one region of area of the external surface of the container structure being textured or roughened or otherwise treated in similar manner to provide a comparable effect.

In a preferred embodiment, the container structure defined is substantially spheroidal. Alternatively, the container structure defined may be substantially cylindrical, the axial dimension of the cylinder approximating to the diametrical dimension of the cylinder, so that a substantially dumpy container is provided.

In a favoured construction, the release portion is removable from the body portion for optional refilling of the container. The body portion is suitably substantially deformable, to facilitate expulsion of liquid contained therein by external squeezing of the body portion.

The release portion preferably comprises a frame portion and a seal portion, the frame portion being engageable with the body portion in a substantially leakage-free or sealing manner, and the seal portion being displaceable relative to the frame portion to occlude or expose a discharge outlet for the passage of liquid therethrough. Suitably, the seal portion is rotationally displaceable relative to the frame portion. Rotational displacement of the seal portion relative to the frame portion may be delimited between respective end positions.

In a container according to the invention, said frame portion and said seal portion suitably together define a solid segment of the container structure, such as a segment of a sphere, and are located entirely within an external dimensional envelope defined by said container structure, at least in the occluding condition of the seal portion. Said frame portion is preferably connected to the container body by means of a screw connection to provide the required high quality of sealing engagement against any release of contents other than by way of deliberate action using the seal portion of the cap.

The rotational displacement of the seal portion relative to the frame portion is suitably accompanied by axial displacement of the seal portion relative to the frame portion to occlude or expose said discharge outlet. Said axial displacement of the seal portion relative to the frame portion is achieved in a favoured construction by co-operating drive features provided on said seal portion and frame portion respectively.

In a variant of the container according to the invention, the frame portion may be mounted to be resistant to an opening displacement of the frame portion being effected by an opening displacement of the seal portion.

Said body portion and said release portion preferably comprise plastics mouldings.

In a second aspect, the invention provides a release portion for a container for liquid, the release portion comprising a frame portion and a seal portion, characterised in that the seal portion is rotationally displaceable relative to the frame portion, to occlude or expose a discharge outlet for the passage of liquid therethrough.

Rotational displacement of the seal portion relative to the frame portion is delimited between respective end positions. The rotational displacement of the seal portion relative to the frame portion may be accompanied by axial displacement of the seal portion relative to the frame portion to occlude or expose said discharge outlet. This axial displacement of the seal portion relative to the frame portion is preferably achieved by co-operating drive features provided on said seal portion and frame portion respectively.

Said release portion is suitably provided by plastics moulding.

The invention also extends to a container for liquid such as a beverage substantially as described herein with reference to and as shown in any one or more of the accompanying drawings. The invention also encompasses a release portion for a container for liquid, in particular a liquid such as a beverage, substantially as described herein with reference to and as shown in any one or more of the accompanying drawings.

BRIEF DESCRIPTION OF THE DRAWINGS

The invention will now be described in detail with reference to an embodiment and a variation thereof, having regard to the accompanying drawings, in which.

DETAILED DESCRIPTION OF THE DRAWINGS

Figure 1:
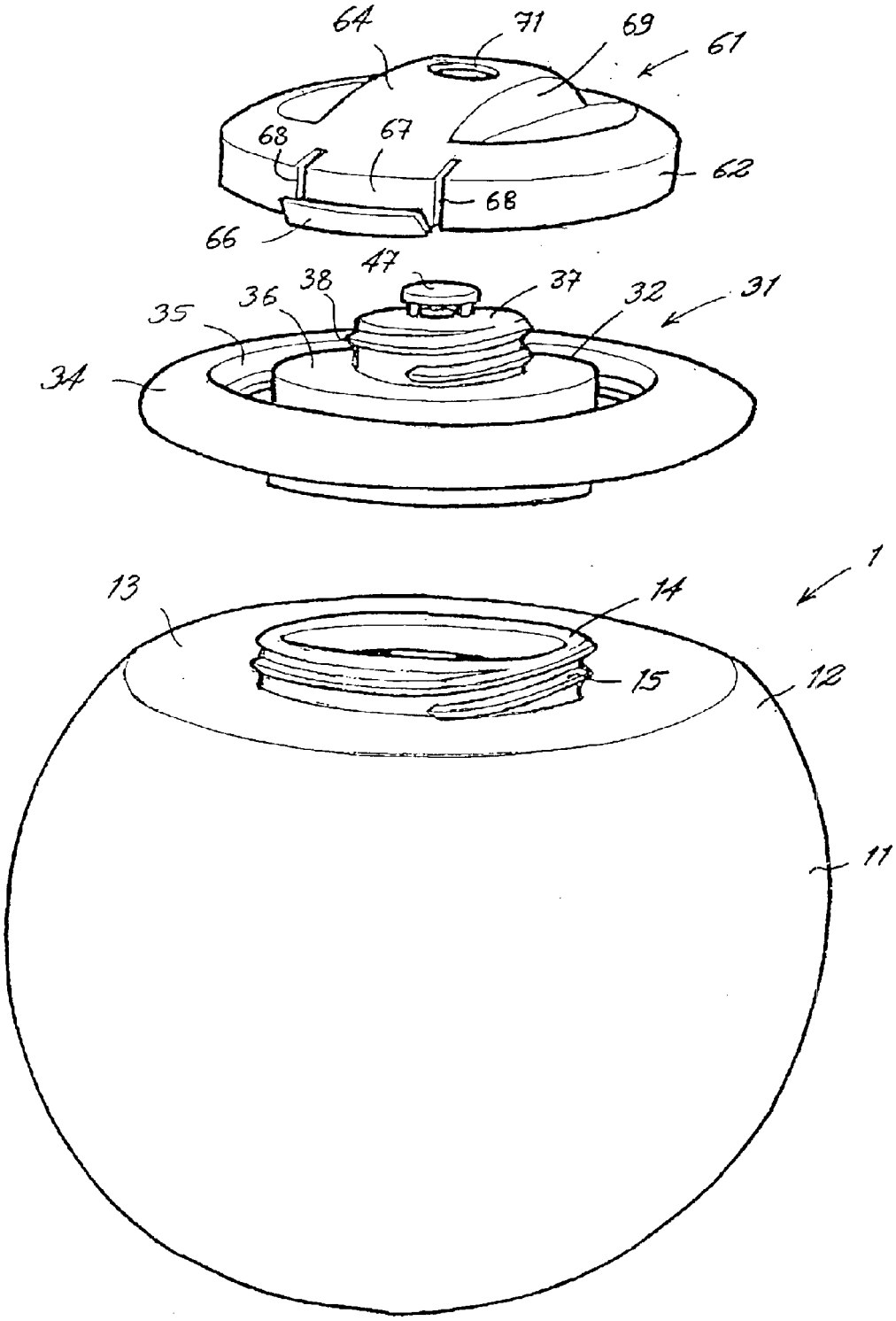
FIG. 1 shows an exploded view of a container according to the invention for a liquid such as a beverage.

FIG. 1 shows an exploded view of a container 1 according to the invention for a liquid such as a beverage. The container 1 consists of a body portion 11, a cap frame 31 and a cap seal 61. When the three components 11, 31, 61 of the invention are assembled together, the container 1 as a whole is substantially spheroidal in shape. Thus the vessel or container 1 according to the invention has a shape which is substantially that of a ball, and its size is selected so as to be readily throwable by hand for catching and retrieval by a recipient. A suitable size of container 1 which is particularly advantageous in meeting this requirement is one which accommodates approximately 500 millilitres of liquid, for example, a beverage, more specifically 430 ml.

The body portion 11 of the container or vessel 1 is substantially spheroidal, as shown in FIG. 1, over the majority of its volume, but terminates in an upper region 12 at a planar face 13, which can be regarded as being defined by a cutting plane delimiting a boundary between the substantially spheroidal major or lower portion of the container 1 and a notionally removed segment of the sphere. Centrally within this planar upper end face region 13, there extends axially an upstanding collar or spigot portion 14, which is externally threaded 15 for reception The cap frame 31 has a central cylindrical body portion 32 defined by a downwardly extending peripheral skirt, on the interior wall surface of which there is defined an internal screw thread 33 (FIGS. 9–11) for co-operation with the external screw thread 15 of the body portion 11. This cylindrical skirt region 32 is surrounded by a peripheral annular portion 34 of the cap frame 31, the exterior surface of which defines a continuation of the spherical or smooth external surface of the body portion 11 when the two components, namely body portion 11 and cap frame 31, are assembled together. The cylindrical skirt 32 and the spherically shaped region 34 are separated by an annular trough or groove 35, which serves for reception of an outer annular or peripheral skirt portion 62 of the cap seal component 61 of the container of the invention.

At the upper end of the inwardly threaded cylindrical portion 32 of the cap frame 31, there is defined a substantially planar surface 36. From the centre of this surface 36, there extends axially an externally threaded upward projecting portion 37. This upward projection 37 has an external screw thread 38 for reception of a co-operating internal screw thread 63 (FIGS. 15 and 16) of the cap seal 61. At an upper end face of the projection 37, the projection 37 is also provided with outflow arrangements, subsequently described, for enabling discharge of the contents from the assembled container 1.

The cap frame 31 is screwed onto the external thread 15 of the upstanding collar or spigot 14 of the body portion 11 by means of the cap frame internal screw thread 33. The thread may be continuous around the periphery or circumference of the collar, as shown in FIG. 1, or it may be discontinuous or partial, with the screw thread arrangement on the collar providing a partial thread in the circumferential direction around the upstanding collar of the body portion. A multi-start thread is preferably also provided. Thus, in the arrangement shown, two thread profiles are present in the axial sense, to provide a two-start thread structure, but a three-start thread may also be used. The cap frame 31 may be arranged to be removable from the body portion 11 by a single turn, the pitch of the thread 15 and the co-operating internal thread 33 of the cap frame 31 being selected to facilitate this action.

The two-part top seal is required to fulfil two functions. The first function is to create a seal against the container body 11 and is established by the frame portion 31 being screwed to the upstanding neck of the container body. The second function is to provide for the beverage to released as required for consumption by a user. Both of these functions are required to be achieved within the dimensional and operational constraints of the product, so that with the cap applied, the product maintains its smooth external profile, in the preferred construction a sphere. Accordingly, the requirement for the product to be capable of being thrown, caught and rolled during use on a sports field is maintained, while also ensuring that a reliable seal is provided at all times against inadvertent loss of contents.

Further details of the cap frame 31 are described with reference to subsequent detailed drawings, but as will again be apparent from FIG. 1, the peripheral region 34 of the cap frame 31 defines a continuation of the spherical or smooth external surface of the body portion 11 when the cap frame 31 is placed in position on the body portion 11, while the external threading 38 of the central upstanding generally cylindrical projection 34 co-operates with the internal thread 63 of the cap seal 61.

The upstand 37 extends from the upper surface 36 of the central generally cylindrical portion 32 of the cap frame 31, which portion 32 terminates in the upward direction at the substantially planar upper surface 36. The outer diameter of the cylindrical portion 32 is greater than the diameter of the threaded projecting upstand 37. The periphery of this cylindrical portion 32 defines a generally cylindrical skirt portion of the cap frame 31, which extends downwardly from the planar upper surface 36 of the cylindrical portion 32. The cylindrical portion 32 is spaced from the peripheral region 34 by the intermediate trough or groove 35, and the peripheral region 34 is supported annularly outwardly of the cylindrical portion 32 by means of bridging sections 39 (FIGS. 7 and 11) between the lower edge of the cylindrical skirt 32 and an inner wall or skirt region 41 of the peripheral portion 34, which skirt 41 defines the outer annular wall of the trough or groove 35. Thus two substantially axially aligned skirt portions 32, 41 are provided, one annular skirt 32 defining the outer periphery of the cylindrical part of the cap frame 31 and the inner wall of the trough 35, and the other annulus 41 defining the inner wall of the peripheral region 34 and the outer wall of the trough 35. These annular walls 32, 41 are separated by the trough or groove 35 and linked together by the bridging portions 39 at the base of the trough or groove 35, the trough 35 having therefore a substantially U-shaped cross-section in transverse view in the region of the bridging portions 39.

The general structure of the cap seal 61 provides a domed upper region 64 from which there depends downwardly the external skirt portion 62 which is received within the trough 35 of the cap frame 31 in the assembled condition of the container 1. A further downwardly directed generally cylindrical inner skirt 65 carries the internal thread 63 of the cap seal 61 on the inner wall surface of the skirt 65. Both the inner 65 and outer 62 peripheral skirts are substantially axially symmetrical about the axis of symmetry of the cap seal 61 which is also the axis of symmetry of the container or vessel 1 as a whole.

Figure 15:
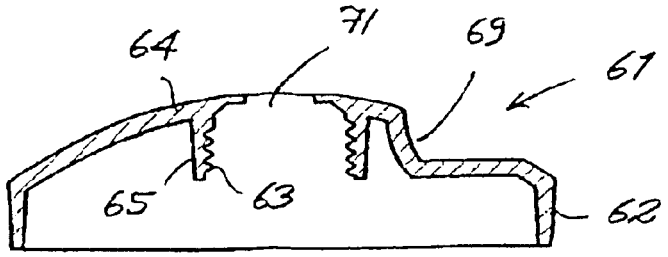
FIG. 15 is a side-sectional view of the cap seal of FIG. 12 on the line A—A of FIG. 12.
Figure 16:
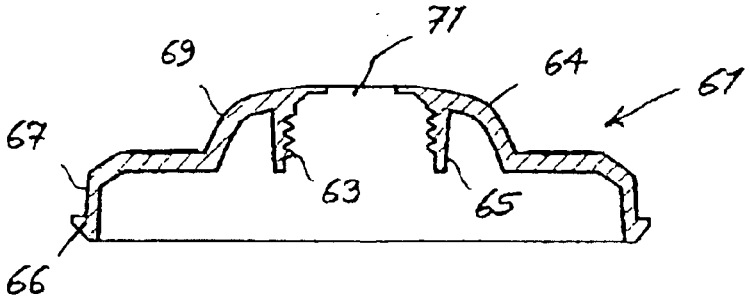
FIG. 16 shows a side-sectional view of the cap seal of FIG. 12 on the line B—B.

The cap seal 61 of the invention is received on the upstanding externally threaded portion 37 of the cap frame 31 by means of the cap seal internal thread 63 (FIGS. 15 and 16). A continuous thread is again preferably provided on this component also, as for thread 15 on collar 14 of body portion 11, or alternatively, a partial thread may be used on the upstand of the cap frame, with for example three threaded areas or portions or regions being provided, each extending circumferentially over slightly less than 60° of the periphery of the upstand. By virtue of a partial thread arrangement of this kind, the threading of the upstand may be interrupted peripherally by unthreaded upstand sections, each unthreaded section extending circumferentially around the cylindrical outer surface of the upstand between threaded portions or regions of the periphery over an angular extent of slightly more than 60°. In a particular construction, each of the three threaded segments may extend over 58° while each unthreaded section then has an angular extent of 62°. Four thread profiles can be used in a multi-start arrangement, so that the cap seal can be screwed onto the cap frame by a quarter turn of the cap seal relative to the cap frame. Alternatively, and preferably, as shown in FIG. 1, a two-start continuous thread is used, as for the collar 14 of main body portion 11 and the co-operating internal thread of the cap frame 31. The arrangements of the respective threads between the body portion and cap frame and cap frame and cap seal respectively are suitably selected so that the upper cap thread releases with less torque than is required to release the lower body portion thread. This means that in use of the container, when the cap seal is released to allow ejection of the contents of the container for use by a participant in a field sport, the releasing action effected on the cap does not cause the main closure to become unsealed.

Appropriate selection of thread arrangements on the respective components ensures that such an eventuality is precluded. An alternative cap frame retaining arrangement may also be provided, as subsequently further described in a variety of further embodiments and variants in the invention.

This screw thread arrangement 38, 42, 43 also facilitates a situation in which the cap seal 61, when secured to the cap frame 31 by screwing on, is then retained on the cap frame 31 but is nonetheless also able to rotate within a limited prescribed angular region or range relative to the cap frame 31 so as to enable both opening of the container 1 to withdraw a portion of its contents and also subsequent closing and resealing of the vessel 1 for retention of the remaining contents. Retention of the cap seal 61 on the cap frame 31 is achieved during the initial screwing-on of the seal 61 onto the frame 31 by the action of two laterally extending projection portions 66 of the cap seal 61, which are delimited at the free ends of resilient portions or arms 67 of the outer skirt 62 of the cap seal 61. These portions 67 are separated from the general structure or body of the cap seal 61 by slits 68 in the outer skirt 62 defined in or parallel to a plane extending through or parallel to an axial plane of the assembled container 1, this plane being defined with respect to and comprising the axis of symmetry of the container 1. The displaceable end regions of the resiliently hinged arms 67 define the latching and camming projections 66, the edges of which are curved or arcuate in plan view to match the peripheral curvature of the cap seal 61 as seen in plan view.

When the cap seal 61 is screwed onto the cap frame 31 for the first time, the resilient portions or arms 67 are squeezed slightly inwards as the projections 66 enter into the trough 35. As the cap 61 is screwed further onto the frame 31, advancing axial movement of the arms 67 into the trough 35 eventually brings the projections 66 into a disposition in which they spring outwardly to engage within cutaway regions 45 of the cap frame (FIGS. 7 to 10). The upper edges of the cutaway regions 45 in the axial direction towards the cap seal define camming surfaces 44 of arcuate configuration matching the arcuate shape of the projections 66. Once the projections 66 lock under the camming surfaces 44, the cap seal 61 is held on the cap frame 31 against removal of the cap seal 61 from the frame 31. Limited axial displacement of the cap seal 61 remains however available within predefined axial limits set by the circumferentially-spaced apart ends of the cutaway region 45, which define end stops delimiting the extent of the available rotational movement between the cap seal 61 and the cap frame 31. Thus in summary, an initial screwing-on movement of the cap seal 61 onto the cap frame 31 is concluded by the cap seal 61 entering into a disposition in which it is substantially non-removably mounted on the cap frame 31, other than by the exercise of special operations.

Figure 8:
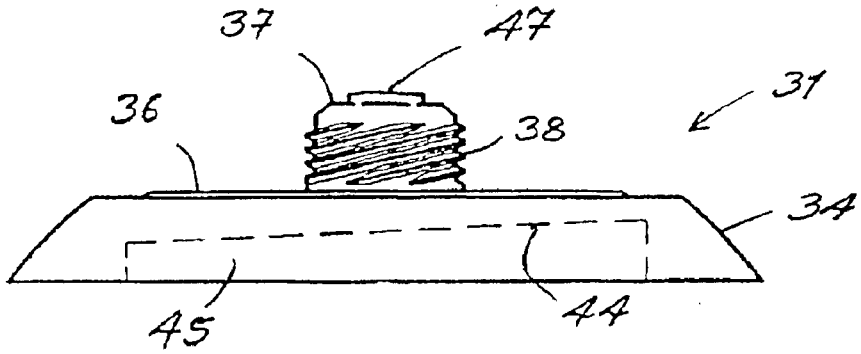
FIG. 8 is a side view of the cap frame of FIGS. 6 and 7.

In the assembled condition of the cap seal 61 in the cap frame 31, these lateral arcuate projections 66 engage under associated arcuate camming surfaces 44 (FIGS. 7–10) of the cap frame 31, which are also inclined or sloped in the peripheral direction of the cap frame 31 (see FIG. 8). When the cap seal 61 is rotated relative to the cap frame 31, there is associated axial movement of the cap seal 61 relative to the cap frame 31. Co-operating camming action takes place between the projections 66 of the cap seal 61 and the camming surfaces 44 of the cap frame 31. The degree of radial projection of the features 66 is shown in exaggerated manner in FIG. 7 and in a practical construction, the radial projection 66 extends outward of the general periphery of skirt 12 to only a slight extent.

These camming surfaces 44 are defined in the outer annular wall of the trough 35 of the cap frame 31 by cutaway regions 45 which extend upwardly from the base of the trough 35 over part of the height of the outer trough wall 41 and extend circumferentially over portions of the periphery of the trough 35. The camming surfaces 44 are defined by upper faces of these cutaway regions 45. When the cap seal 61 and cap frame 31 are assembled together, the lateral projections 66 of the cap seal snap into these cutaway regions 45 of the cap frame 31 and move along the arcuate extent of these cut-out portions 45 between end stops defined by the circumferentially spaced apart end faces of the cutaway regions or slots 45 when the cap seal 61 is rotated relative to the cap frame 31 within the arcuate region permitted by the end stops, i.e. the circumferentially spaced apart end faces of the cutaway regions or camming slots 45. The relative arrangement of the respective screw threaded regions 63 on the cap seal 61 and 38 on the cap frame 31 are such that following the initially screwing together of the cap seal 61 and the cap frame 31, the resiliently hinged projections 66 of the cap seal 61 snap outwardly into the camming cutaway regions or recesses 45 of the cap frame 31 and the two components 31, 61 are held together in a manner permitting relative rotation of the cap seal 61 with respect to the cap frame 31, during which relative axial displacement of the cap seal 61 with respect to the cap frame 31 is effected. The extent of this axial displacement is controlled inter alia by the camming interengagement of the resilient projections 66 and the camming surfaces 44 of the cutaway regions 45 of the cap frame peripheral annular portion 34 in its inner skirt wall 41.

A partial thread may used for both the external thread of the upstanding projection of the cap frame and for the internal thread of the cap seal. For this purpose, each threaded section may extend over an arc of 58° in the circumferential direction while a clear (unthreaded) section of 62° is then provided for each 120° sector of the periphery of the externally threaded region. However, as indicated, a continuous thread structure may alternatively be provided, suitably in a two-start arrangement, as in the preferred construction identified.

The internal thread 33 of the cap frame 31 suitably travels through one turn for removal of the cap frame 31 from the container body portion 11. Three thread profiles may be provided for the co-operating body portion thread and cap frame thread, or alternatively and preferably, a two-start thread. One-quarter of a turn of the cap seal 61 relative to the cap frame 31 is required for clearing the outlet feature of the container 1, at the upper end of the cap frame projection 37. A four-start thread arrangement may, in a further variant, be provided for the thread of the cap frame and for the thread of the cap seal, but two-start is preferred. The inclination of the camming surfaces 44 is matched to the lift created by the threads 38, 63 in the axial direction for a rotation through 90°.

The external surface 64 of the cap seal 61 is again generally shaped to match the surface of curvature of the body portion 11, so that when the cap seal 61 and the cap frame 31 are assembled together with the body portion 11, the external periphery of the assembled vessel or structure 1 is generally spheroidal, the cap 61 having however indentations or recesses 69 to facilitate manual engagement for twisting of the cap seal 61 in its disposition of retention on the cap frame 31 between a container open orientation and a container closed or sealed orientation. Two such gripping features are shown in FIG. 1, but alternative configurations are possible.

To use the invention, the cap seal 61 and the cap frame 31 are associated together by screwing the cap seal 61 onto the cap frame 31. When this screwing together is completed, the cap seal 61 is retained on the cap frame 31 against disengagement by co-operating interengagement of the resiliently mounted projections 66 of the cap seal 61 with and beneath the camming surfaces 44 of the peripheral slots 45 of cap frame 31, but the cap seal 61 is rotatingly displaceable relative to the cap frame 31 within a defined angular region or range, during which the cap seal 61 also undergoes axial displacement relative to the cap frame 31. The relative rotation of seal 61 and frame 31 is also limited by the camming interaction of resilient projections 66 and surfaces 44. At its centre, the cap seal 61 has a substantially circular outlet opening 71 which overlies an outlet region of the cap frame 31 located at the upper end of the central substantially cylindrical upstand 37 of the cap frame 31. The association of the cap seal 61 with the cam frame 31 is such that in one end position of angular displacement of the cap seal 61 relative to the cap frame 31, the container outlet 71 is closed off, whereas in the other end position of angular displacement of these components 31, 61 relative to each other, the outlet opening 71 is exposed for liquid to be withdrawn through it. In order to facilitate discharge from the container of the invention, the body portion 11 is formed to be pliable to at least a limited degree, so that it may be squeezed to expel liquid contained therein. The degree of pliability however must not be such that the container is deformable in the region of the top collar and thread. It must be sufficiently stable and rigid in this region so as to avoid any possibility of the screwed-together structure coming apart when the pliable portion of the container body is squeezed to expel the contents. For reasons of weight and balance, it may is also be provided that additional material is embodied in the portion of the container structure away from the head and cap region, in order to act as a counterbalance to any additional weight arising out of the provision of the cap and the intermediate frame.

When cap seal 61 and frame 31 are assembled together, liquid, non-gasified, is filled into the body portion 11 and the assembled cap structure 61, 31 is screwed onto the body 11. With the cap seal 61 in the closed position, the unit 1 is then closed against exit of liquid. The filled ball-shaped container or vessel 1 may be thrown on a sports field to an intended recipient, in the manner of any other ball, and a skilled ball player will have no difficulty in catching it. Alternatively, it may be rolled along the ground, and because of its spherical shape, when fully charged, will follow a substantially linear path. Thus the cap assembly 31, 61 as a whole is applied to the container when it has been filled to close off its interior. The assembly as a whole may be removed again when the container is empty in order to enable it to be refilled. The regions of the cap frame 31 which engage with the container body 11 provide for sealing engagement of the cap unit as a whole against the container body 11. The unit is therefore proof against any significant leakage when in a closed condition and liquid can only be released by positive action by a user, any other egress being precluded by the screw-on cap frame engaging in sealing manner against the container body 11.

For release of the contents for use, for example on a sports field during play or intervals in play, the discharge feature of the invention is enabled by displacement of the cap seal 61 relative to the cap frame 31 to allow withdrawal or expulsion of the beverage within the container for consumption by the user. The closure assembly fufils therefore two functions, a first container-sealing function and a second selective enabling of contents discharge on an occasion of the user's choosing. The container 1 is suitably filled with a still drink, for example at a factory or bottling plant, prior to its first occasion of use. When the original contents have been consumed, the release portion defined by the cap frame 31 and cap seal 61 may be removed as a single closure unit and the body portion 11 refilled with an appropriate still beverage.

Figure 2:
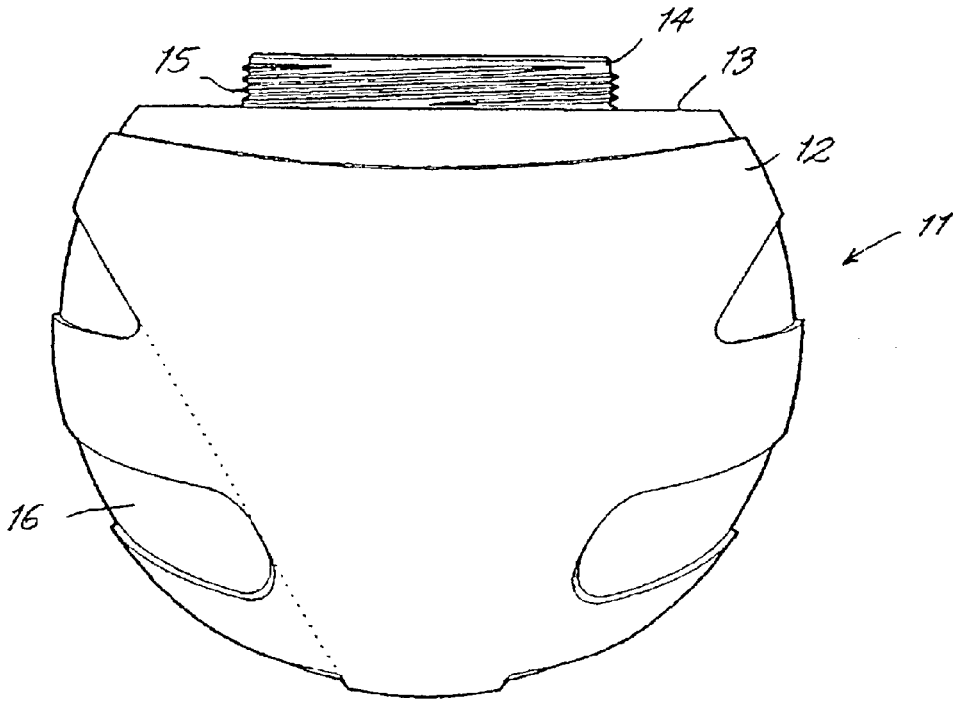
FIG. 2 is a side view of the body portion of a container in accordance with FIG. 1.
Figure 3:
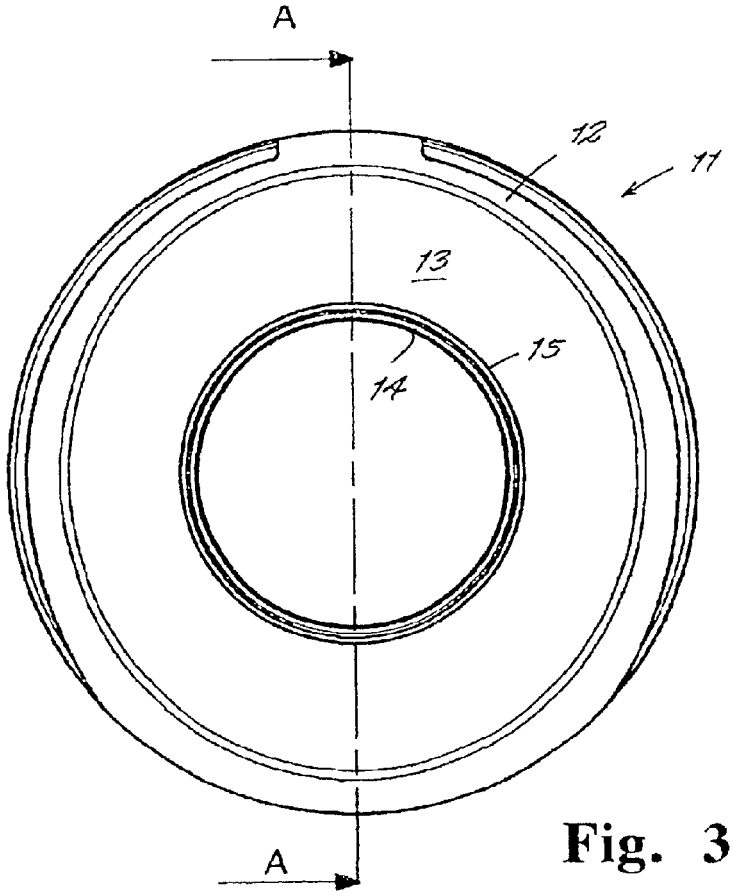
FIG. 3 is a top view of the body portion of FIG. 2.
Figure 4:
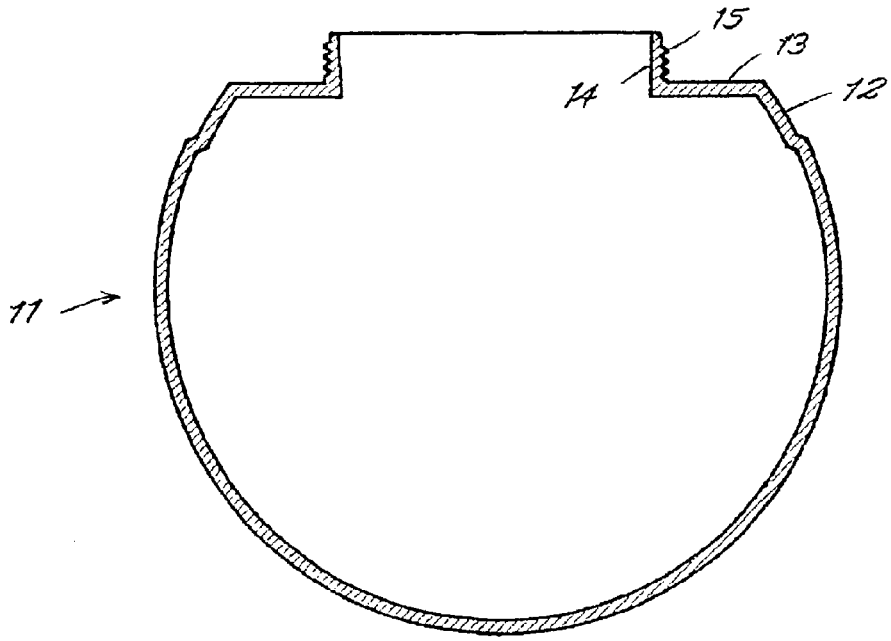
FIG. 4 is a side-sectional view of the body portion of FIGS. 2 and 3 on the line A—A according to FIG. 3.

Detail of the body portion 11 is shown in FIGS. 2, 3 and 4. The general spheroidal configuration of the unit portion 11 will be noted, as also will the threaded central upstand 14 on the planar upper end face 13 of the unit portion 11. As will be seen in particular from FIG. 2, the exterior of the body portion 11 may be configured in any desired manner, such as by recesses or indentations 16 as shown in the drawing, for ease of gripping and attractive appearance. The recesses or indents 16 will be seen from FIG. 2 to be separated by intervening areas or lands 17 which are raised relative to the depressed regions defined by the indentations 16. These recesses and lands together define or constitute aesthetic aspects of the invention while also facilitating or contributing to the gripability of the product and its capability for being readily handled during use, such as on a sports field. It will also be apparent that the generally spheroidal structure could be defined by a multiplicity of facets or planar regions of relatively small individual area, should such a construction be desirable or preferred.

In a variant of the construction shown, the external surface of the container 1 may be provided with one or more roughened or textured areas or regions, to further facilitate gripping of the container during use. These gripping or higher friction regions are embodied in the moulded product by appropriate treatment of the moulds during the toolmaking process, in a manner known in itself. While the process applied is referred to a "texturing" or "roughening", these terms are to be understood as embracing any like or similar treatment resulting in improved gripability of the unit of the invention, especially during use with beverage accommodated within the container.

In a favoured construction, the external texturing or like arrangement is provided by a series of outwardly directed dimples or comparable features, provided suitably on raised aesthetic elements of the unit. These dimples enable manual engagement of the unit with improved security of gripping. The outward arrangement of the dimples inhibits the accumulation of dirt and unwanted residues on the external surface of the unit.

The dimpling of the external surface to provide enhanced gripping capability for the product of the invention represents one of a multiplicity of manners in which such a gripping facility may be incorporated in the product. Texturing is typically provided on plastics products in accordance with substantially standardised reference systems. At the design stage, the need for texturing to be applied to a particular surface or area is indicated and a suitable technique is then selected in conjunction and cooperation with the toolmaker or supplier of the mould. Tool features to provide surface texturing on the moulded product may be established such as by electro-sparking or chemical etching.

In an alternative variant, it would be possible for a strip or band of another material of high adherent properties to be embodied into the moulded product or applied to its exterior, so that the gripping capability of the unit may be engendered in a different manner. It will be appreciated that the gripping features described represent merely a small number of a multiplicity of possible solutions and are not to be regarded as definitive.

Figure 5:
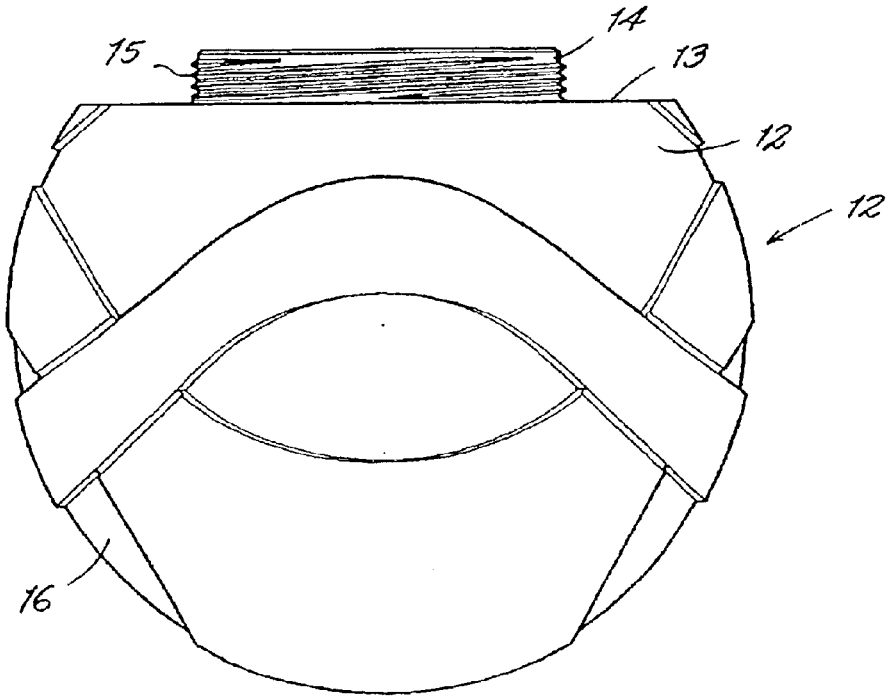
FIG. 5 shows an alternative embodiment of body portion, in which the external configuration and patterning differs from that of FIG. 2, the body structure being however otherwise the same in its technical features as the embodiment of FIGS. 2, 3 and 4.

These external characteristics of the body portion 11 may be varied without affecting the scope of the invention, and an alternative external configuration is shown in FIG. 5. In the arrangement of FIG. 5, aesthetic features are provided by external bands or ridges 18, which also facilitate gripping and manual engagement of the unit. The outward or raised dimples are again provided on the external surface, in particular on the raised bands or ridges. Accordingly, ease and security of handling of the unit is enabled in a diversity of manners. In the drawings of the body portion 11 as shown in FIGS. 2–5, a full thread 15 is shown, but partial threading may alternatively be provided, i.e. a thread which is interrupted circumferentially. A three-start thread profile 15 is shown in FIGS. 2–5, as compared with the two-start arrangement of FIG. 1.

Figure 6:
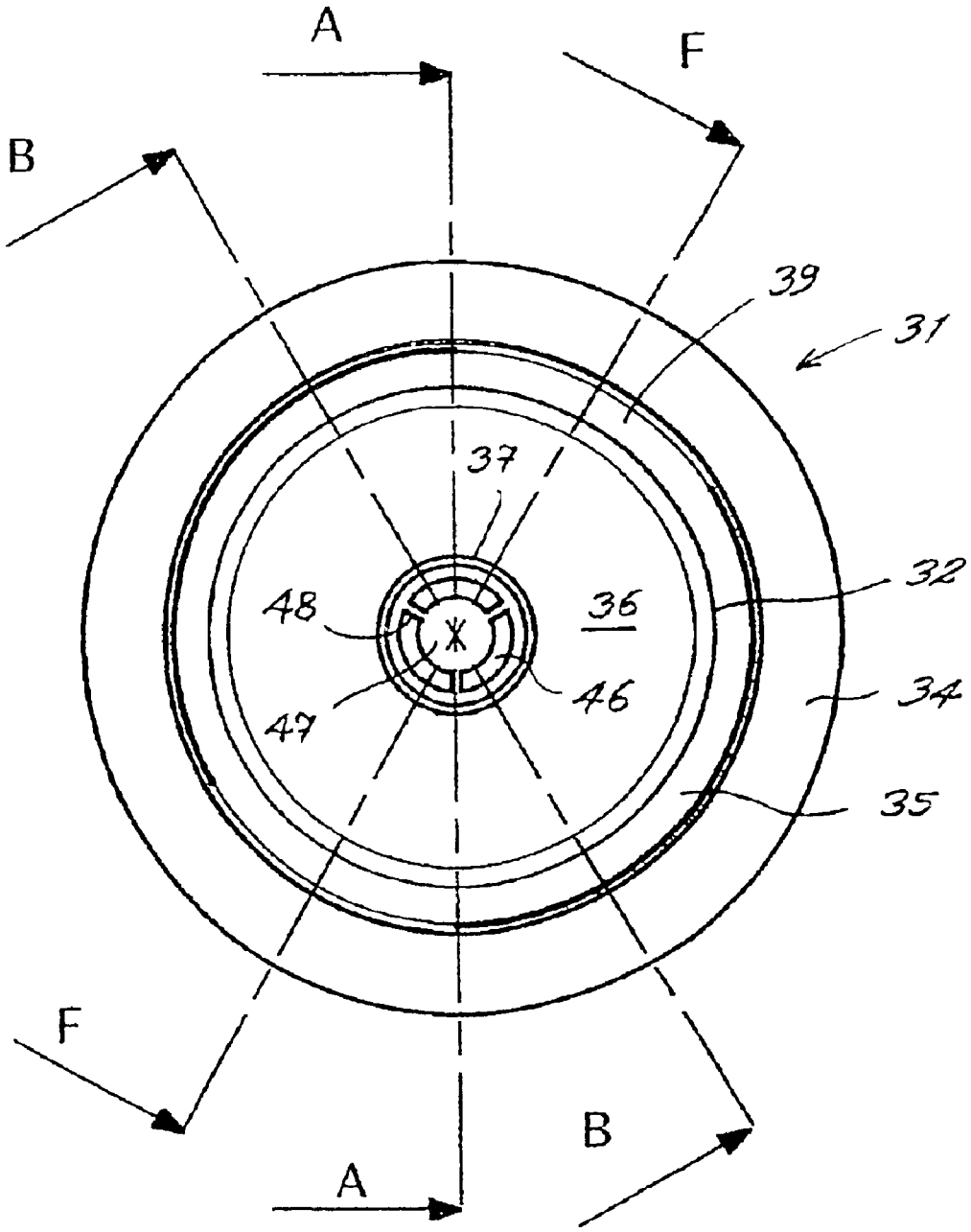
FIG. 6 shows a top view of the cap frame of the container of the invention according to FIG. 1.
Figure 7:
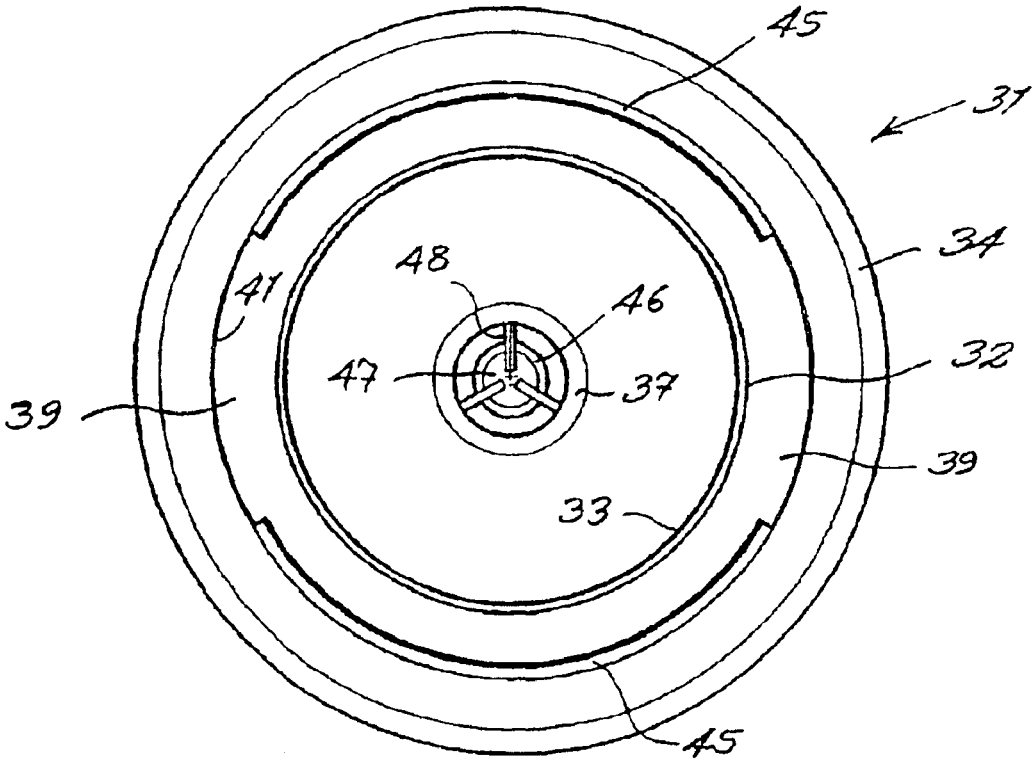
FIG. 7 is a bottom view of the cap frame of FIG. 6.

FIGS. 6, 7 and 8 show external views of the cap frame 31. In the top view of FIG. 6, outlet apertures 46 are shown at the upper end face 36 of the upward projection 37 of the cap frame 31, these being a series of arcuate slots, three in number, surrounding a central disc portion 47 which is supported from the outer wall (FIGS. 9–11) of the upstand 37 by three radial limbs 48 and stands slightly above the level or plane of the three arcuate outlet aperture segments 46. The curved peripheral outer surface 34 of the cap frame 31 is also to be noted, this representing a continuation of the spheroidal surface of the body portion 11 in the assembled condition of the container 1.

In the bottom view of FIG. 7, the cap frame 31 camming structures 44 which co-operate with the resiliently displaceable projections 66 of the cap seal 61 are shown. These portions 44 are defined by side surfaces of the arcuate slots 45 which are provided on opposite sides of the cap frame 31 to each extend over approximately 120°. This leaves two 60° spaces between the arcuate ends of these camming surfaces 44 and slots 45, where the cap frame 31 structure is continuous or solid to provide the bridging sections 39 at the base of the trough 35, by which the outer annulus 34 is supported and spaced radially outwardly of the inner skirt 32. The camming surfaces 44 are defined by the sides of the arcuate slots 45 which are uppermost in the normal disposition of use of the vessel 1. FIG. 7 also shows the internal thread 33 by which the cap frame 31 is screwed onto the threaded collar 14 of the body portion 11.

As will be seen in the side view of FIG. 8, these camming surfaces 44 which co-operate with the resilient projections 66 of the cap seal 61 extend with increasing height from a low end at one arcuate extremity to a high end at the other arcuate extremity. It will thus be seen that when the cap seal 61 is mounted on the cap frame 31, its lateral projections 66 undergo axial displacement during twisting of the cap seal 61 on the cap frame 31, together with axial movement of the cap seal 61 as a whole relative to the cap frame 31. As the cap seal projections 66 move towards the "low" ends of the camming surfaces 44 of slots 45, the cap seal 61 is pulled down onto the cap frame 31. Thus while the axial movement of the cap seal and the cap frame is brought about by the co-operating threaded portions of these components, circumferential limitation or stop features are provided by the abutment regions at each end of camming surface and the co-operating radial projections, while also, complete sealing of the unit in the closed disposition is achieved by the pulldown feature of the camming arrangements. The wedging action on conclusion of the camming movement in the closing direction also ensures that the cap does not inadvertently move towards the open position during throwing or other handling of the filled unit.

Figure 9:
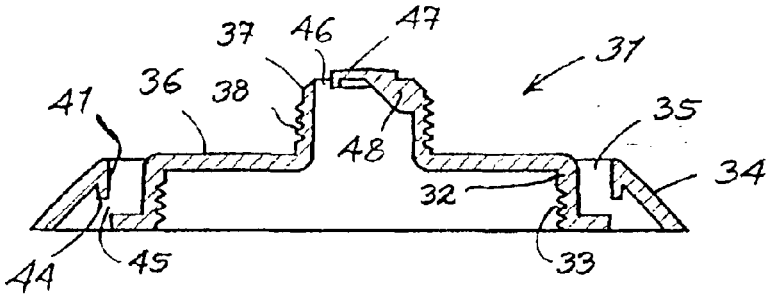
FIG. 9 is a sectional view of the cap frame of FIG. 6 on the line A—A of FIG. 6.
Figure 10:
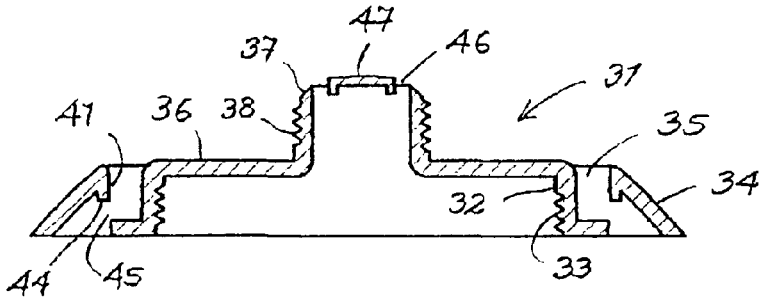
FIG. 10 is a sectional view of the cap frame of FIG. 6 on the line B—B of FIG. 6.
Figure 11:
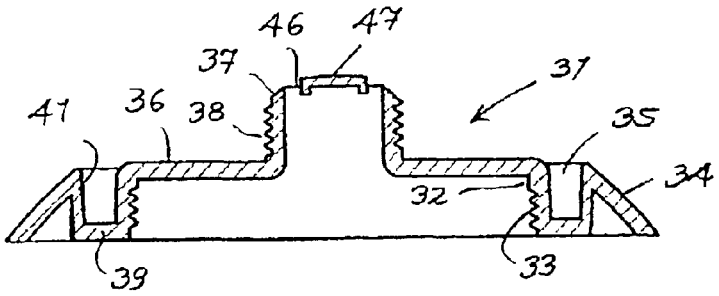
FIG. 11 is a side-sectional view of the cap frame of FIG. 6 on the line F—F of FIG. 6.

In the sectional views of FIGS. 9, 10 and 11, taken on the respective section lines as indicated in the brief description of the drawings, the mounting arrangement for the central disc 47 for occluding the outlet opening 71 of the cap seal 61 will be apparent. This disc 47 also defines the arcuate sectors 46 through which fluid may be withdrawn, these segments 46 being located between the outer periphery of the disc 47 and the edge or rim of the generally tubularly-shaped upstand 37. Also shown are the cutaway regions or slots 45 where engagement of the lateral projections 66 of the cap seal 61 takes place. As between FIGS. 9 and 10, the greater vertical dimension of the gap by which the camming surface 43 is defined will be apparent, as between from its "low" end and its "high" end.

FIGS. 9, 10 and 11 in particular also show in detail the arrangement by which the downwardly directed outer peripheral skirt 62 of the cap seal 61, in which the resilient retaining features 66 of the cap seal 61 are formed, is received within the cap frame 31. Immediately radially inward of the spherical segment defining surface 34, there is provided the trough 35 which extends in a U-shaped manner downwardly from the upper substantially planar surface 36 of the cap frame 31, at the centre of which surface 36, the projection 37 extends axially upwardly. This trough 35 is defined by the two side walls 32, 41 and the connecting base region 39. On the inner face of the inner side wall 32 of the trough region 35, i.e. the wall surface directed away from the trough 35, there is defined the internal thread 33 by means of which the cap frame 31 is secured to the body portion 11. This inner skirt 32 of the trough 35 is circumferentially continuous over its axial extent, but the outer wall 41 of the trough 35 is interrupted over parts of its height by two diametrically opposite arcuate portions which define the arcuate slots 45 within which the resilient projections 66 of the cap seal 61 are retained. The upper surfaces of these arcuate slot portions 45 define the camming surfaces 44 already discussed.

Figure 12:
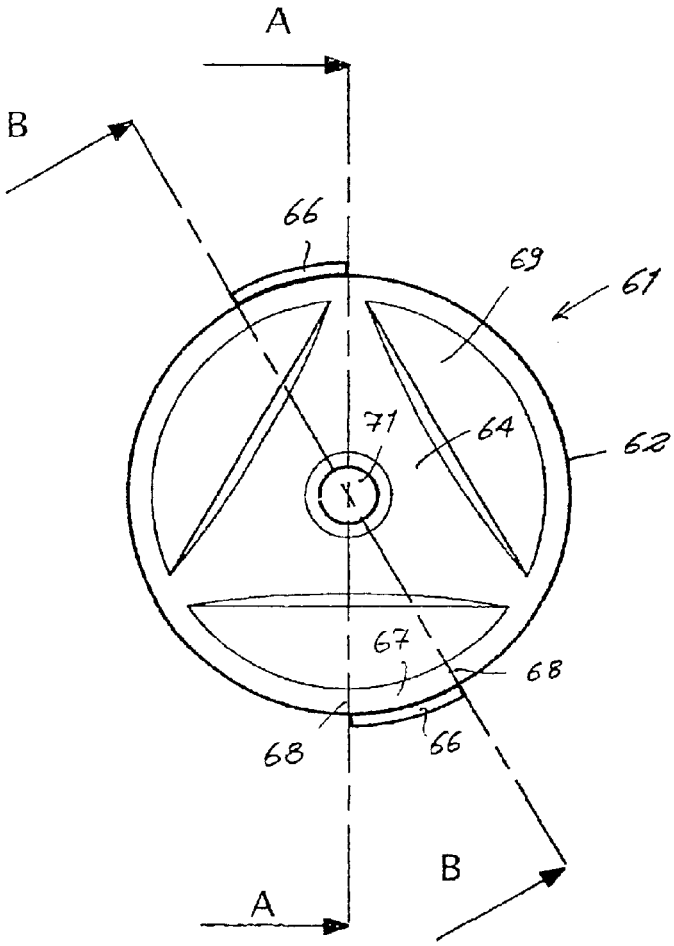
FIG. 12 is a top view of the cap seal of the invention as shown in FIG. 1.
Figure 13:
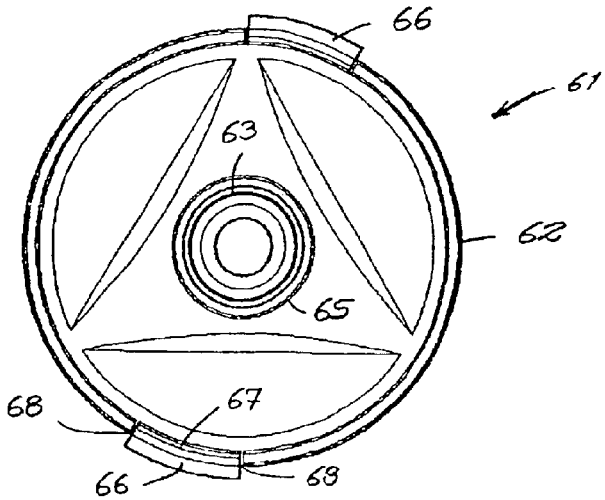
FIG. 13 is a bottom view of the cap seal of FIG. 12.
Figure 14:
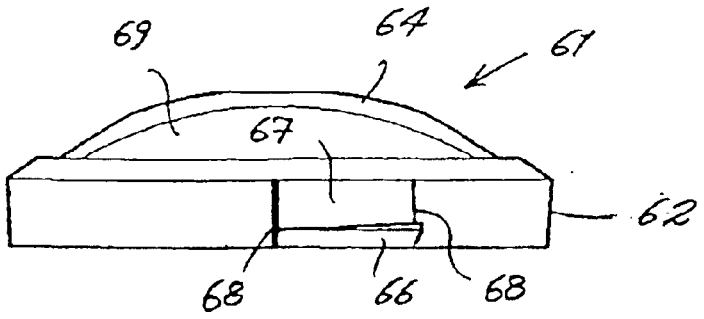
FIG. 14 is a side view of the cap seal of FIGS. 12 and 13.

Turning now to FIGS. 12, 13 and 14, the cap seal 61 is shown, the lateral projection 66 of the resilient features 67 of the cap seal 61 being apparent in particular from the top and bottom views of FIGS. 12 and 13. The cap seal 61 has the general shape of a dome, with a generally cylindrical lower portion or inner skirt 65 which screws down onto the externally threaded projection 37 of the cap frame 31, and a partially domed upper region 64 provided with lateral indentations 69 to define gripping surfaces to enable rotation of the cap seal 61 relative to the cap frame 31 by manual engagement of the cap seal 61. The central outlet opening 71 provides for egress of liquid from the container 1, in co-operation with the outlet apertures 46 of the cap frame 31.

FIG. 12 also shows three gripping features 69 as compared with the two such indentations of FIG. 1. Other variants may also be considered.

As will be further apparent from FIG. 14, the lateral projections 66 are defined at each arcuate end by the substantially vertically extending slits 68 in the cylindrical outer skirt portion 62 of the cap seal 61. Thus the resilient arms 67 extend downwards from the dome portion 64 of the cap seal 61 into the generally cylindrical side-skirt region 62 in a resiliently hinging manner, by way of an integral hinge in the preferably plastics moulded cap seal structure 61. Upwardly-directed surfaces of the laterally extending projection parts 66 at the lower ends of these hinge regions or resilient portions 67 are in each case also provided with a sloping surface, typically 3°, to match the sloping surface of the camming portions or surfaces 44 of the cap frame 31.

The lateral projection features 66 will be further apparent from the sectional views of FIGS. 15 and 16, of which FIG.

15 shows a cross-section in the region of the structure not having lateral projections 66, while FIG. 16 shows the section through the lateral projections 66. The radial projection of features 66 may, as previously indicated, be reduced in a practical implementation of the invention, as compared with the radial extent shown on the drawings. Also shown is the internal axially aligned skirt 65 on the interior of which the internal thread 63 is defined for enabling cap seal 61 to be screwed onto cap frame 31.

Figure 17:
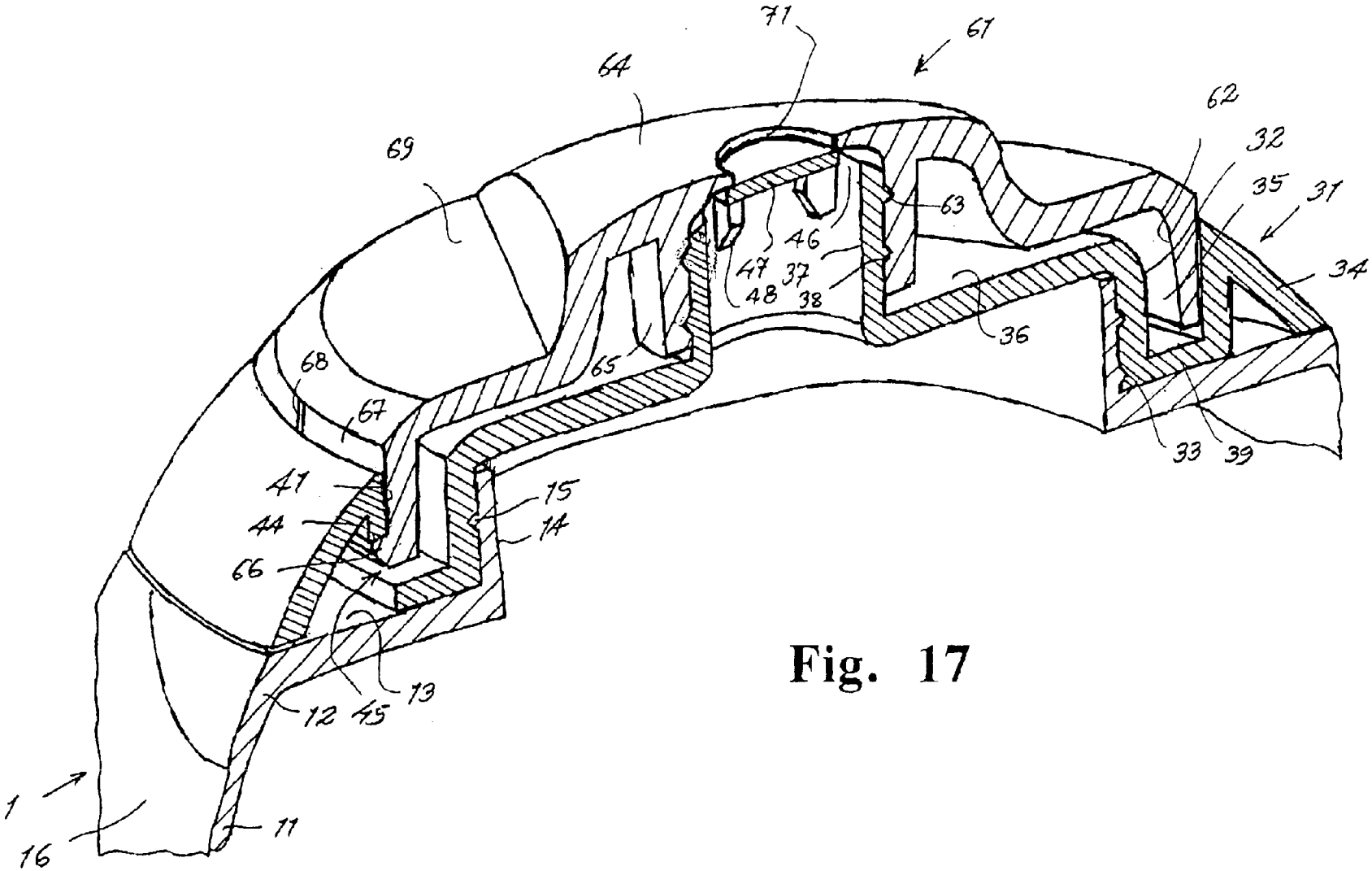
FIG. 17 is a pictorial representation of the container of the invention in a closed disposition.
Figure 18:
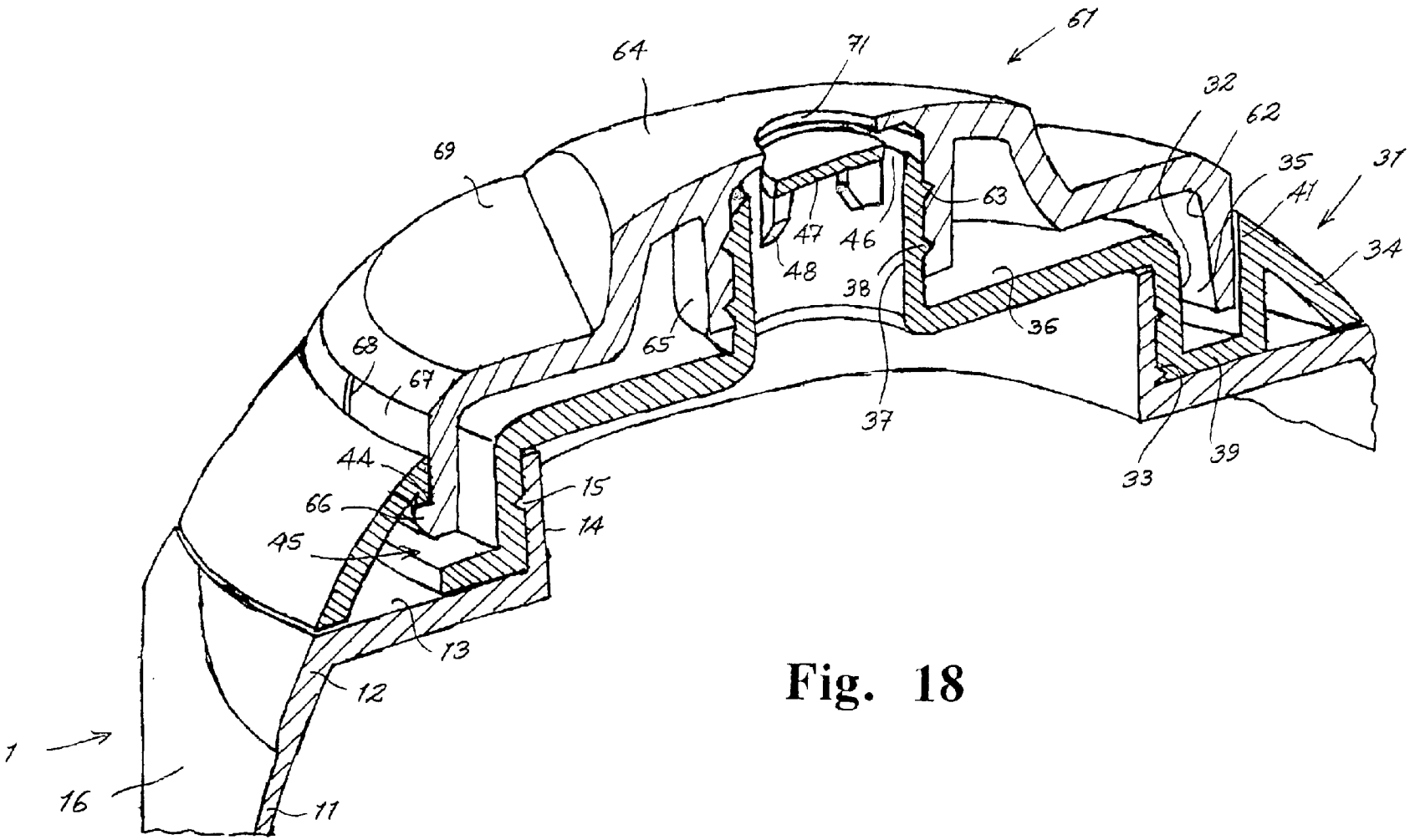
FIG. 18 shows an enlarged pictorial representation of the sealing region of the container according to the invention, in a release or open disposition.

The operation of the sealing or closing feature is now described with respect to FIGS. 17 and 18. In FIG. 17, the unit is shown in a sealed disposition, with the cap seal 61 twisted relative to the cap frame 31 so that the periphery of the outlet opening 71 of the cap seal 61 sits down in sealing manner over the arcuate outlet openings 46 of the cap frame 31 and the central disc 47 of the cap frame 31 is received within the circular outlet opening 71 of the cap seal 61. In FIG. 18, by contrast, the cap seal 61 has been twisted so that the lateral projections 66 have moved towards the axially higher ends of the camming surfaces 44 and the cap seal 61 has moved axially upwards. The outlet opening 71 of the cap seal 61 is thereby moved away from the central disc 47 of the cap frame 31 in the outlet region of the cap frame projection 37, to expose the arcuate outlet openings 46. The contents of the container, such as for example a liquid or beverage for consumption, may then pass through the outlet openings 46, 71 for the refreshment of a user. Closure of the container 1 is then effected by reverse twisting of the cap seal relative to the cap frame, when the user has consumed sufficient liquid. Thus effectively drive features are provided as between the cap seal and the cap frame by which the rotational movement of the cap seal relative to the cap frame is translated into an axial opening and closing action for the discharge aperture. These drive features include the co-operating screw thread portions of the cap frame and cap seal respectively name the external thread on the upstanding collar of the cap frame and the internal thread on the skirt of the cap seal, in co-operation with the camming or wedging features provided by the camming surfaces of the cap frame and the radially projecting cam portions of the cap seal. In addition to fulfilling a partial drive function, these co-operating camming features also delimit the permissible circumferential displacement of the cap on the assembled unit. Thus stop features are also defined by the camming structures.

In order to avoid any possible loosening of the retention of the cap frame on the container body during opening and closing movement of the cap seal by the stop-limited rotation of the cap seal relative to the cap frame, any suitable cap frame-retaining feature may be applied, in addition to or as an alternative to any arrangement already previously described. For example, the cap frame my be held against opening rotation by a latch arrangement entered into on completion of a cap frame closing movement when the container has been filled. The latch arrangement is such as to be overcome as required by reverse movement of the cap frame for opening the container for refilling, but not to be overriden during rotation of the cap seal. Alternatively, and representing a preferred construction, the directions of the respective threads for closure of the cap frame and displacement of the cap may be reversed relative to one another, so that if the frame mounting thread is right hand, the seal opening and closing thread is left hand, or vice versa. In this way, opening movement of the seal represents closing action on the frame, so that any danger of the cap frame being inadvertently turned to open the container during action to discharge the beverage for consumption is substantially eliminated.

The invention is especially beneficial in field sports, where a player in urgent need of hydration may receive a container 1 thrown to him from the sidelines. Alternatively, the container 1 may be rolled to the user along the ground. The invention extends to any configuration of body portion 11 facilitating such throwing or substantially linear rolling travel. Thus in addition to strictly spheroidal shapes, either the body portion 11 or the container structure 1 as a whole may deviate to some degree from this general configuration, provided that the above criteria continue to be met. In particular, the container 1 may resemble a small version of a rugby ball, and thus be substantially ovoid. Alternatively, the body portion 11 in particular may take the form of a dumpy cylinder, of substantial transverse dimension relative to its axial length, so as to be particularly suited to directed rolling movement, while also being throwable and catchable with a reasonable degree of convenience and accuracy.

The invention is preferably moulded from plastics material, and as already indicated, it may have a great diversity of external configurations and patterning. A variety of suitable plastics materials may be applied to manufacture of the product, the main body portion of which is especially suited to production using blow-moulding techniques. Thus, the lower part of the product, the main container body portion 11, is suitably blow-moulded and may be formed from a material such as PET, polyethylene. An appropriate composition of material may be established by suitable experimentation. The upper or cap element of the unit, which consists of the two components, frame 31 and seal 61, is injection-moulded. Suitable materials for the cap components include a thermoplastic such as ABS, acetyl butene styrene, or any other high impact styrene. Alternatively, a polypropylene may be used.

What is claimed is:

1. A container for liquid comprising:

a body portion for accommodating liquid; and a release portion for selective release of liquid contained in the body portion, wherein the body portion and release portion together define a substantially spheroidal container structure shaped to facilitate at least one of manual throwing, catching of the container, and rolling of the container along the ground while liquid is accommodated within the container, wherein the release portion comprises:

a frame portion; and a seal portion;

wherein the frame portion is engageable with the body portion in a substantially leakage-free or sealing manner, and wherein the seal portion is displaceable relative to the frame portion to occlude or expose a discharge outlet for passage of liquid therethrough.

2. A container according to claim 1, wherein the body portion defines a greater proportion of the container structure and the release portion comprises a lesser proportion of the container structure, the body portion and the release portion together defining a substantially continuous external surface of the container structure.

3. A container according to claim 1, wherein the external surface of the container structure is provided with one or more features to facilitate manual engagement of said external surface.

4. A container according to claim 3, wherein said features to facilitate manual engagement comprise at least one raised or recessed region or area of the external surface of the container structure.

5. A container according to claim 3, wherein said features to facilitate manual engagement comprise at least one region of area of the external surface of the container structure which is textured or roughened or otherwise treated in similar manner to provide a comparable effect.

6. A container according to claim 1, wherein the release portion is removable from the body portion for optional refilling of the container.

7. A container according to claim 1, wherein the body portion is substantially deformable, to facilitate expulsion of liquid contained therein by external squeezing of the body portion.

8. A container according to claim 1, wherein said frame portion and said seal portion together define a solid segment of the substantially spheroidal container structure, and are located entirely within an external dimensional envelope defined by said container structure, at least in the occluding condition of the seal portion.

9. A container according to claim 1, wherein said frame portion is connected to the container body by means of a screw connection.

10. A container according to claim 1, wherein the seal portion is rotationally displaceable relative to the frame portion.

11. A container according to claim 10, wherein the rotational displacement of the seal portion relative to the frame portion is delimited between respective end positions.

12. A container according to claim 10, wherein the rotational displacement of the seal portion relative to the frame portion is accompanied by axial displacement of the seal portion relative to the frame portion to occlude or expose said discharge outlet.

13. A container according to claim 12, further including co-operative drive members for axially displacing the seal portion relative to the frame portion.

14. A container according to claim 1, wherein the frame portion is mounted to be resistant to an opening displacement of the frame portion being effected by an opening displacement of the seal portion.

15. A container according to claim 1, wherein said body portion and said release portion comprise plastics mouldings.

16. A container for liquid comprising:

a body portion for accommodating liquid; and a release portion for selective release of liquid contained in the body portion;

wherein the body portion and release portion together define a container structure shaped to facilitate at least one of manual throwing, catching of the container, and rolling of the container along the ground while liquid is accommodated within the container, wherein the release portion comprises:

a frame portion having a first discharge outlet; and a seal portion having a second discharge outlet;

wherein one of the frame portion and the seal portion carries a sealing member that occludes or exposes the second discharge outlet upon displacing the seal portion relative to the frame portion, and wherein the frame portion and seal portion has co-operating drive members for displacing the sealing member relative to the second discharge outlet, the co-operative drive members comprising at least one lateral projection carried by one of the seal portion and the frame portion and a camming portion carried by the other of the seal portion and the frame portion, the camming portion engaging the lateral projection and displacing the second discharge outlet relative to the sealing member upon rotating the seal portion relative to the frame portion.

17. A container according to claim 16, wherein the seal portion and the frame portion together form a solid segment to form a substantially spheriodal container structure, and the release portion is located entirely within an external dimensional envelope defined by the container structure, at least in the occluding condition of the seal portion.

* * * * *